US006006789A

United States Patent [19]

Toyooka et al.

[11] Patent Number: 6,006,789

[45] Date of Patent: Dec. 28, 1999

[54] METHOD OF PREPARING A STEEL PIPE, AN APPARATUS THEREOF AND A STEEL PIPE

[75] Inventors: Takaaki Toyooka; Akira Yorifuji; Motoaki Itadani; Toshio Ohnishi; Yuji Hashimoto; Nobuki Tanaka; Hiroyuki Matsui, all of Handa, Japan

[73] Assignee: Kawasaki Steel Corporation, Kobe, Japan

[21] Appl. No.: 08/776,664

[22] PCT Filed: Aug. 21, 1996

[86] PCT No.: PCT/JP96/02334

§ 371 Date: Jan. 31, 1997

§ 102(e) Date: Jan. 31, 1997

[87] PCT Pub. No.: WO97/07906

PCT Pub. Date: Mar. 6, 1997

[30] Foreign Application Priority Data

| | | | |
|---|---|---|---|
| Aug. 25, 1995 | [JP] | Japan | 7-239079 |
| Aug. 25, 1995 | [JP] | Japan | 7-239080 |
| Jun. 27, 1996 | [JP] | Japan | 8-167257 |

[51] Int. Cl.[6] ..... F16L 9/00; B23K 31/06; B21C 37/30

[52] U.S. Cl. ..... 138/171; 228/102; 228/149

[58] Field of Search ..... 72/97, 206, 208; 250/358.1; 148/12.4, 593; 266/4, 90; 264/28; 138/171, 97, 140; 228/102, 149; 204/129.35; 285/55

[56] References Cited

U.S. PATENT DOCUMENTS

| | | | |
|---|---|---|---|
| 3,604,238 | 9/1971 | Asari | 72/206 |
| 3,874,211 | 4/1975 | Hayashi | 72/208 |
| 4,075,041 | 2/1978 | Ueno et al. | 148/12.4 |
| 4,139,139 | 2/1979 | Hiraoka et al. | 228/102 |
| 4,834,344 | 5/1989 | Hoetzel et al. | 266/90 |
| 4,883,292 | 11/1989 | Kuroki | 285/55 |
| 5,294,309 | 3/1994 | Seimiya et al. | 204/129.35 |
| 5,335,841 | 8/1994 | Yamanashi | 228/149 |
| 5,657,659 | 8/1997 | Yamada | 72/208 |
| 5,873,960 | 2/1999 | Kondo et al. | 148/593 |

FOREIGN PATENT DOCUMENTS

| | | |
|---|---|---|
| 60-15082 | 1/1985 | Japan . |
| 63-33105 | 2/1988 | Japan . |
| 63-49323 | 3/1988 | Japan . |
| B2-2-24606 | 5/1990 | Japan . |
| 2-187214 | 7/1990 | Japan . |
| 5-228533 | 9/1993 | Japan . |

*Primary Examiner*—Andres Kashnikow
*Assistant Examiner*—Davis Hwu
*Attorney, Agent, or Firm*—Oliff & Berridge, PLC

[57] ABSTRACT

A steel mother pipe obtained by a solid phase butt-welding pipe-making process or a welding pipe-making process is reduced by heating the pipe prior to the reduction at a temperature exceeding 100° C. and lower than 800° C. wherein the temperature of the steel pipe being reduced is controlled within a defined range. The temperature difference along the circumferential direction of the mother pipe at the inlet side of a reducer is within a defined range, and the temperature of the steel pipe at interstand positions of the reducer is also controlled. By virtue of this control, the reduction becomes possible at low load while suppressing work hardening without degrading surface properties. The resultant product pipe has a dimensional accuracy maintained at a high level.

15 Claims, 13 Drawing Sheets

METHOD OF PREPARING A STEEL PIPE, AN APPARATUS THEREOF AND A STEEL PIPE

TECHNICAL FIELD

This invention relates to a method for reducing a steel pipe, an apparatus for carrying out the method, and steel pipes prepared by the method and more particularly, to a method for reducing a steel pipe which is made by subjecting both edges of an open pipe to butt welding, an apparatus for carrying out the method, and the steel pipe.

BACKGROUND ART

As a method for preparing a steel pipe with a relatively small diameter from a steel strip, two processes are known including a solid phase welding pipe-making process (i.e. a solid phase pressure-welding pipe-making process) such as a butt-welding process wherein an open pipe formed by continuously forming a steel strip in the form of a pipe is entirely heated to high temperatures and is pressure-welded at both edges thereof, and a welding pipe-making process wherein an open pipe is welded at both edges thereof such as by electric resistance welding, laser welding or the like.

The solid phase welding process is usually adapted for mass production of small diameter pipes with an outer diameter of 115 mm or below. However, this process is disadvantageous in that since the open pipe is heated to high temperatures from the outer peripheries thereof, a scale loss becomes so great that the resultant product becomes poor in surface texture. On the other hand, with the welding process, only both edges of the open pipe are heated to temperatures higher than the melting point at the time of the welding. The portions other than the edges are in a cold condition of 100° C. or below. Thus, the problem of the surface roughening as experienced in the solid phase welding process does not arise. However, this process is a cold process, so that it is necessary to prevent the occurrence of slip defects as will be caused between pipe-making tools, such as a caliber roll, and the open pipe, and to take a measure for suppressing a forming load. Thus, the production efficiency becomes poor. In addition, because the use of caliber rolls which are in conformity with the dimension of a product steel pipe is essential, the welding process is not suited for the small lot and multikind manufacture of steel pipes.

In order to overcome the disadvantages involved in the steel pipe-making method using the solid phase butt-welding process or the welding process, methods of the cold reducing of a steel pipe by welding processes have been proposed as disclosed such as in Japanese Patent Unexamined Publication Nos. 63-33105 and 2-187214.

When, however, a steel pipe obtained by a welding process is subjected to the cold reduction, a great rolling load is required. This, in turn, inevitably requires the installation of a lubricating rolling device for preventing galling or seizing defects with the roll, or the installation of a large-scale mill which can stand use under the great rolling load. Moreover, when a steel strip is formed into a stock pipe (i.e. an open pipe), the strain of the forming is established, to which the work strain caused during the course of the cold reduction is added. Hence, the steel suffers a considerable degree of the work strain, with the attendant problem that after the making of the pipe, a thermal treatment step has to be added.

Further, as disclosed in Japanese Patent Examined Publication No. 2-24606 and Japanese Patent Unexamined Publication No. 60-15082, there have been proposed methods where a steel pipe obtained by a welding process is hot reduced.

However, after the steel pipe formed by this welding process has been hot reduced, the mother pipe is again heated to 800° C. or above in a reheating furnace. The brings about a fresh scale loss, coupled with another problem that when reduced, scale inclusion is induced.

An object of the invention is to solve the problems of the prior art and to provide a method and apparatus for reducing a steel pipe wherein a steel mother pipe prepared according to a solid phase joint or welding process or a welding process is reducible at low load and while suppressing work hardening without worsening the surface properties and wherein the dimensional accuracy of a product steel pipe can be maintained at a high level.

DISCLOSURE OF THE INVENTION

The invention provides a method for preparing a steel pipe by continuously forming a steel strip to form an open pipe, subjecting to butt welding at both edges thereof, and reducing the welded steel pipe by means a plural-stand reducer having caliber rolls, characterized in that the steel pipe prior to the reduction is heated to a temperature higher than 100° C. and lower than 800° C. and then reduced.

The making of the pipe through the butt welding is intended to mean the following weldings.

(1) Butt-welding where an open pipe is entirely heated and both edges are pressure welded.

(2) Moderate temperature solid phase pressure-welding wherein both edges alone of an open pipe are heated.

(3) Moderate temperature solid phase pressure-welding wherein an open pipe is entirely heated and both edges alone are further heated and subjected to solid phase pressure welding.

(4) Electric resistance welding, laser welding or a combination of the weldings at both edges of an open pipe.

The pipe manufacture can be beneficially performed by measuring steel pipe temperatures at an inlet side and an outlet side of a reducer and also at an interstand position or positions and heating or cooling the steel pipe prior to or during the reduction so that the measured values are, respectively, coincident with a preset value.

It is favorable that the steel pipe prior to the reduction is heated to 725° C. or below and reduced in a temperature range of 375° C. or above. Moreover, it is preferred to soak the steel pipe prior to the reduction in such a way that a temperature difference along the circumferential direction of the pipe is within 200° C. More preferably, the steel pipe prior to the reduction is soaked so that a temperature difference along the circumferential direction of the pipe is within 100° C. In this case, it is more favorable to measure the pipe temperatures at the inlet and outlet sides of the reducer and at interstand positions and to heat or cool the steel pipe prior to and during the reduction so that the measured values are coincident with a preset value.

The apparatus of the invention for appropriately carrying out the method of the invention is a steel pipe-reducing apparatus of the type which comprises a solid phase butt-welding device or a welding device, an inlet side heating furnace, and a reducer composed of a plurality of stands sequentially located in this order, thermometers for measuring a steel pipe at inlet and outlet sides of the reducer, and an arithmetic control unit for controlling the inlet side heating furnace based on the measured values from the thermometers, characterized in that an inlet side soaking device capable of both heating and cooling is provided in place of the inlet side heating furnace, additional thermometers and an interstand soaking device capable of both heating and cooling are, respectively, provided between the stands of the reducer, and the arithmetic control device controls the inlet side soaking device and the interstand soaking device based on the measured values from the thermometers between the stands. In this apparatus, it is preferred that heating means of the inlet side and interstand soaking devices are, respectively, constituted of a heating furnace or an induction coil, and cooling means therefor, respectively, consist of a coolant jetting nozzle.

The product steel pipe according to the invention is characterized in that the pipe consists of a seam butt-welded steel pipe and that a surface roughness, Rmax, is 10 $\mu$m or below as reduced. Thus, the pipe has good characteristics.

BEST MODE FOR CARRYING OUT THE INVENTION

Reference is now made to the accompanying drawings to illustrate a prior art technique. An open pipe obtained by continuously forming a steel strip is formed into a pipe by solid phase butt-welding or by welding.

The manufacture of a pipe by solid phase butt-welding has the drawback that the scale loss is so great that the surface texture of a product becomes poor. With the manufacture of a pipe by welding, no problem on the surface roughness arises, but the production efficiency is so low that this manufacturing process is not suited for the manufacture of multikind steel pipes.

Figure 3:
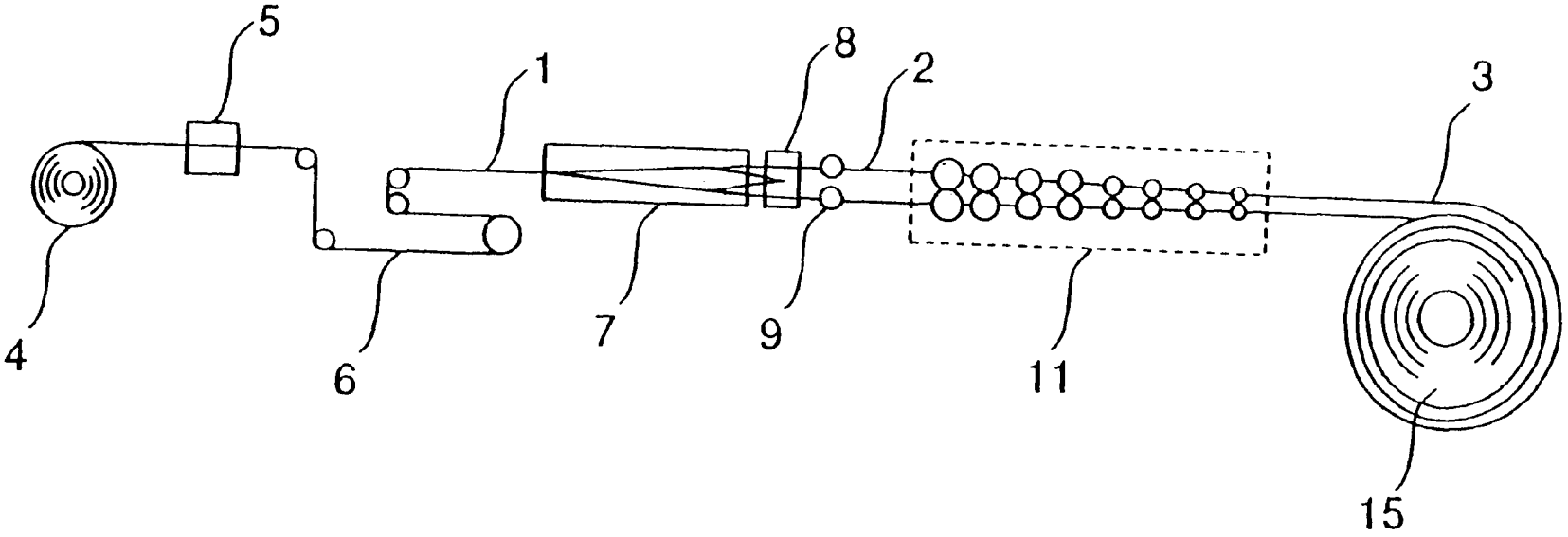
Fig.3 PRIOR ART
FIG. 3 is a schematic view of a prior art method of the cold reduction of a steel pipe.

FIG. 3 is a schematic view showing a method for the cold reduction of a steel pipe obtained by a welding process, in which designated by 1 is a steel strip, by 2 is a mother pipe prior to reduction, by 3 is a product pipe, by 4 is an uncoiler, by 5 is a welding device for different lots of the steel strip 1, by 6 is a looper, by 7 is a pipe forming machine, by 8 is an induction heater, by 9 is a squeeze stand, by 11 is a reducer, and by 15 is a coiler. In this technique, the rolling load is so great that it is essential to install a large-scale mill. Moreover, work hardening of the stock steel is considerable, so that after formation of a pipe, an additional thermal treatment is necessary.

Figure 4:
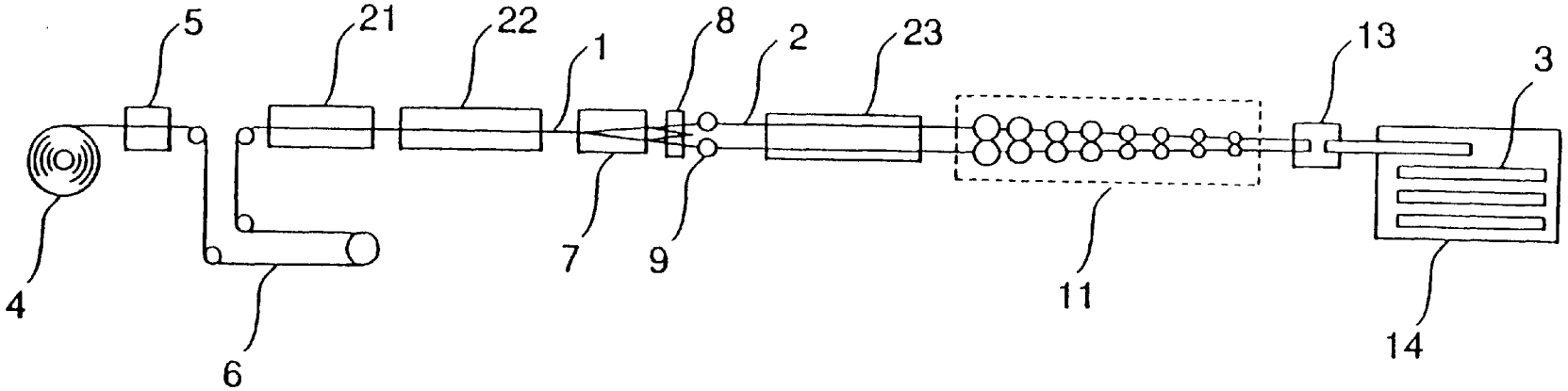
Fig.4 PRIOR ART
FIG. 4 is a schematic view of a prior art method of the hot reduction of a steel pipe.

FIG. 4 is a schematic view showing a method for the hot reduction of a steel pipe obtained by a welding process, in which indicated by 21 is a preheating furnace for a steel strip 1, by 22 is a heating furnace for the steel strip 1, by 23 is a reheating furnace, by 13 is a cutting machine, and by 14 is a cooling bed. Like reference numerals as in FIG. 3 indicate like members and their explanations are omitted.

When the steel pipe obtained by the welding process is hot reduced, the mother pipe is heated in a reheating furnace, during which a fresh scale loss generates and the scale inclusion is induced at the time of the reduction.

The method of the invention is described.

According to the method of the invention, the temperature of a steel pipe prior to reduction (i.e. mother pipe) is regulated within a range of higher than 100° C. and lower than 800° C., by which the surface roughness of a product pipe can be suppressed. Favorable conditions capable of suppressing both surface roughness and work hardening include a mother pipe temperature of 725° C. or below and a rolling temperature of 275° C. or above.

In the practice of the invention, butt-welding may be either solid phase pressure welding of both edges after heating of the entirety of an open pipe to high temperatures (butt welding), or solid phase pressure welding of both edges heated to high temperatures after heating of the entirety of an open pipe to moderate temperatures. Alternatively, electric resistance welding by application of an electric current or through induction heating or laser welding may be used provided that an open pipe is welded at both edges thereof.

Figure 1:
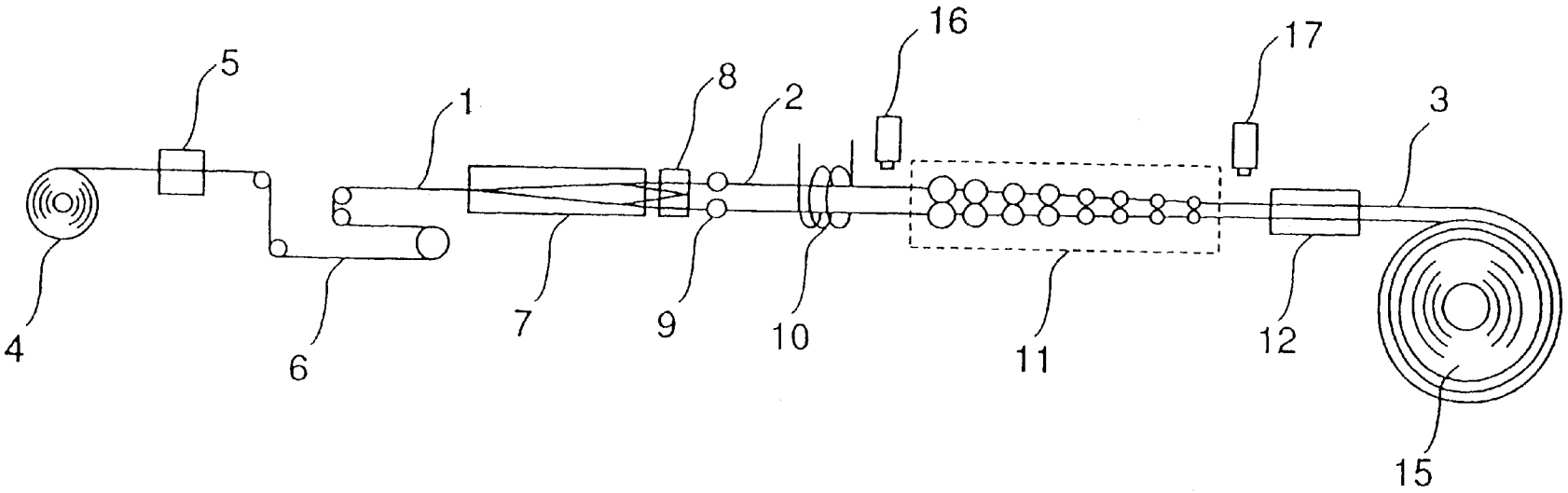
FIG. 1 is a schematic view of an installation arrangement for carrying out the invention.

FIG. 1 is a schematic view of an installation arrangement, with which the invention is carried out. In FIG. 1, indicated by 1 is a steel strip, by 2 is a mother pipe, 3 is a product pipe, by 4 is an uncoiler, by 5 is a welding device for different lots of the steel strip 1 (welding between the tail end of a preceding strip and the tip end of a subsequent strip), by 6 is a looper, by 7 is a stock pipe forming machine, by 8 is an induction heater, by 9 is a squeeze stand, by 10 is an induction heating coil, by 11 is a reducer, by 12 is a pipe correction device, by 15 is a coiler, and by 16, 17 are thermometers.

As shown in FIG. 1, the steel strip fed out from the uncoiler 4 is formed into a pipe by means of the stock pipe forming machine 7. After heating both edges to a temperature lower than the melting point by means of the induction heater 8, the pipe is subjected to solid phase butt-welding (solid phase pressure welding) in the squeeze stand to provide the mother pipe 2 prior to reduction. This mother pipe is heated by means of the induction heating coil 10 over the whole circumferential region of the pipe, followed by reduction in the reducer 11 constituted of plural stands to a given outer diameter to provide a product pipe 3. After correction in the pipe correcting device 12, the pipe is wound up with the coiler 15 and cooled.

The installation arrangement of FIG. 1 may be applied for the reduction of a welded steel pipe if the arrangement is altered in such a way that both edges which have been heated to a temperature higher than the melting point can be welded in the squeeze stand 9.

Figure 2:
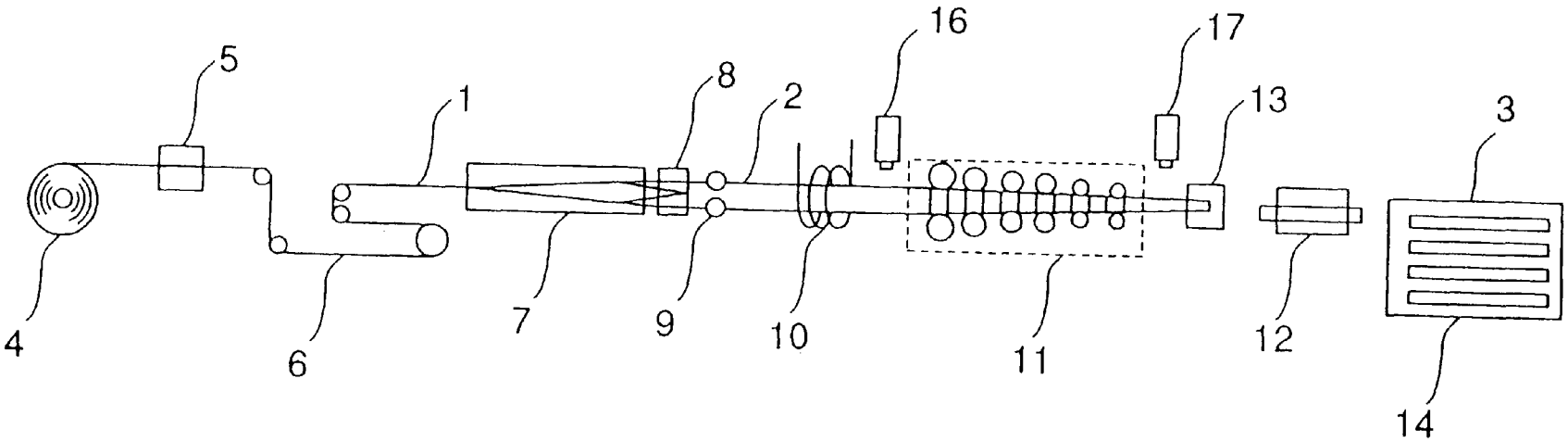
FIG. 2 is a schematic view of another installation arrangement for carrying out the invention.

FIG. 2 is a schematic view of another installation arrangement with which the invention is carried out. In FIG. 2, 13 denotes a cutting machine, and 14 denotes a cooling bed. Like reference numerals as in FIG. 1 indicated like members and their explanations are omitted.

As shown in FIG. 2, the steel strip fed out from the uncoiler 4 is formed into a pipe by means of the stock pipe forming machine 7, followed by heating both edges to a temperature higher than the melting point by means of the induction heater 8 and welding in the squeeze stand 9, thereby obtaining the mother pipe 2 prior to reduction. The mother pipe 2 is heated in the induction heating coil 10 over the whole region of the pipe circumference. The pipe 2 is reduced to a given outer diameter by means of the reducer 11 constituted of plural stands to provide a product pipe 3. After cutting to given lengths by means of the cutting machine 13, the pipe is corrected in the pipe correcting device 12 and cooled in the cooling bed 14.

It will be noted that the installation arrangement of FIG. 1 may be applied for the reduction of a solid phase welded steel pipe if the arrangement is altered in such a way that both edges which have been heated to a temperature lower than the melting point can be welded in the squeeze stand 9.

We made a detailed study on the surface texture of a product pipe, mechanical properties of pipes prior to and after rolling, and a rolling load by use of the installation arrangement of FIG. 1 wherein a carbon steel pipe for piping (outer diameter: 60.5 mm, thickness: 3.8 mm) which had been made according to the solid phase butt-welding process was reduced by 30% at a temperature ranging from normal temperatures to 1000° C. Likewise, using the rolling installation arrangement of FIG. 2, a carbon steel pipe for piping (outer diameter: 114.3 mm, thickness: 4.5 mm), similar studies were made. The invention has been accomplished based on the knowledge which was obtained from the above studies as set out below.

Figure 5A:
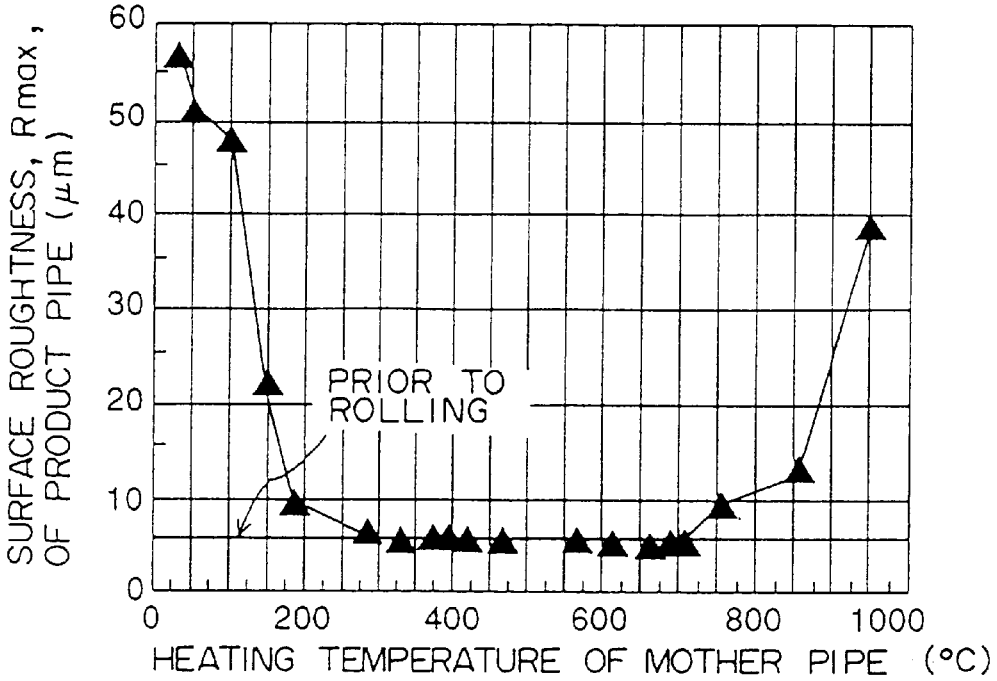
FIGS. 5(*a*) and 5(*b*) are graphs showing the relation between the heating temperature for a mother pipe and the surface roughness, Rmax. of a product steel pipe.
Figure 5B:
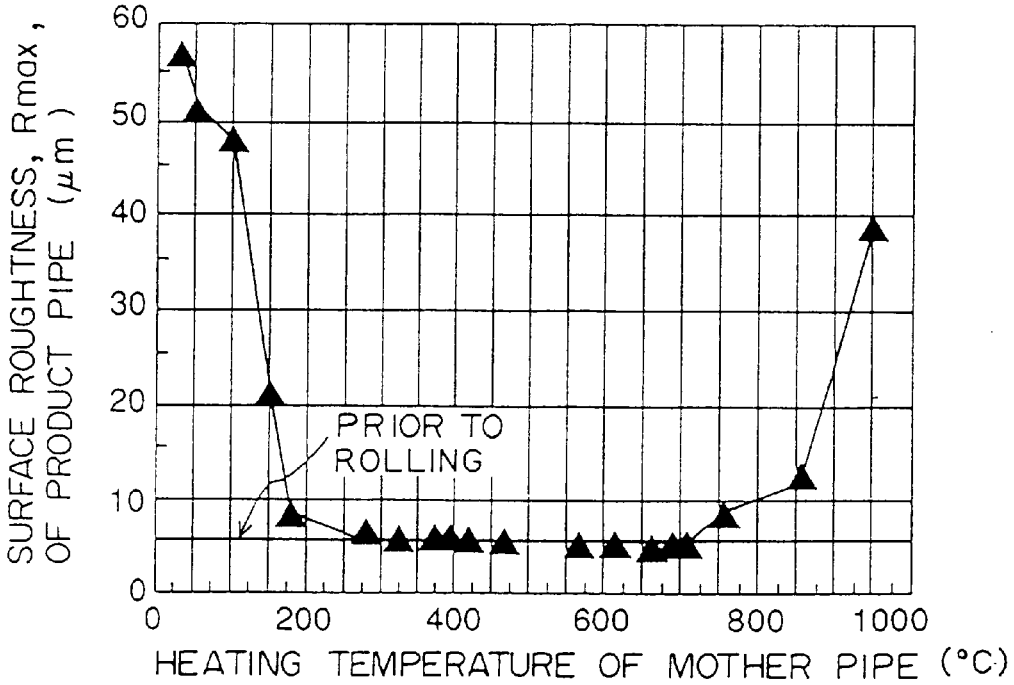

FIGS. 5(*a*) and 5(*b*) are graphs showing the relation between the heating temperature of the mother tube and the surface roughness, Rmax, of a product pipe. FIG. 5(*a*) is for the solid phase butt-welded steel pipe and 5(*b*) is for the welded steel pipe. The surface roughness, Rmax, of a product steel increases owing to the defects resulting from the scale inclusion occurring during the course of the rolling when the heating temperature of the mother pipe is 800° C. or above, or owing to the slip defects with a roll ascribed to the increase in rolling load and the generation of heat when the temperature is 100° C. or below. Thus, the surface roughness becomes great. Accordingly, it is preferred that the heating temperature of the mother pipe exceeds 100° C. but is lower than 800° C. It will be noted that in view of FIGS. 5(*a*) and 5(*b*) more preferable heating temperature of the mother pipe ranges 200–725° C. in order to permit the increment between the values of Rmax prior to and after the rolling to be within 0.5 $\mu$m.

Figure 6A:
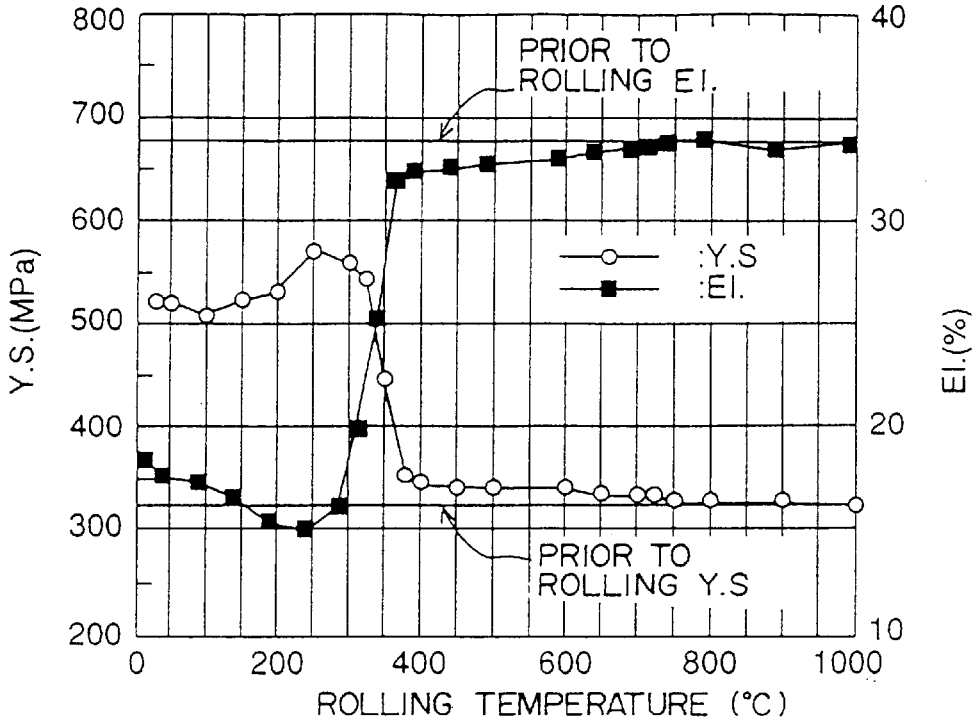
FIGS. 6(*a*) and 6(*b*) are graphs showing the rolling temperature dependency of a yield point and an elongation of a product steel pipe.
Figure 6B:
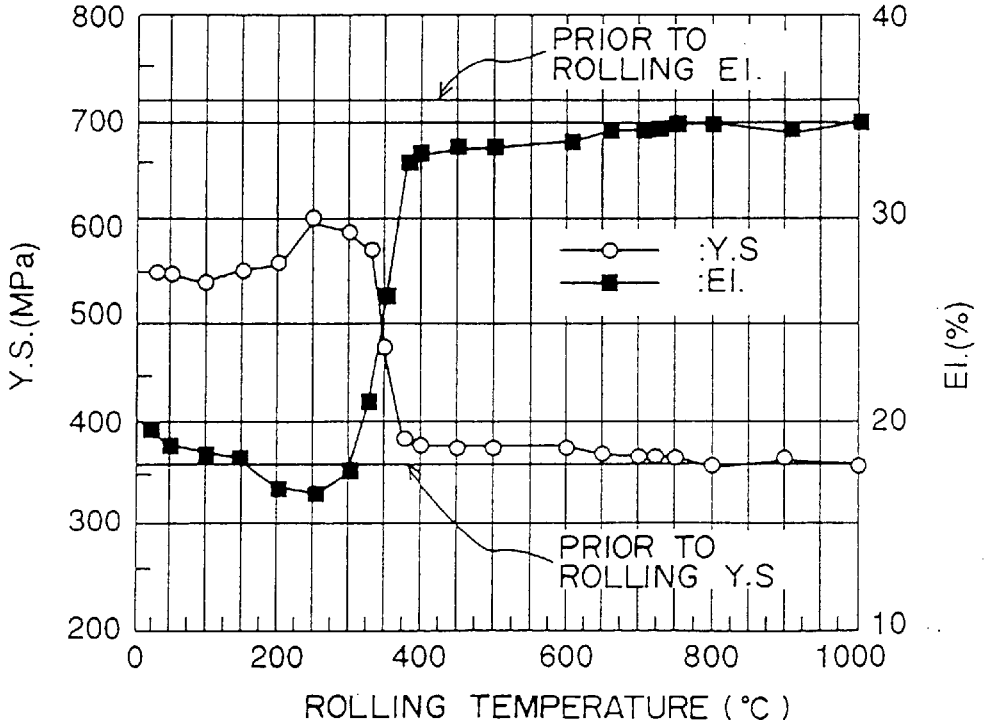

FIGS. 6(*a*) and 6(*b*) are graphs showing the dependency of the rolling temperature on the yield strength (Y.S.) and the elongation (E'.) of a product steel wherein FIG. 6(*a*) is for the solid phase butt-welded steel pipe and FIG. 6(*b*) is for a welded steel pipe. According to FIGS. 6(*a*) and 6(*b*), when the rolling temperature is 300° C. or below, the yield strength increases and the elongation decreases owing to the work hardening caused by a rolling strain on comparison with those determined prior to the rolling. In the range of 300° C. to 350° C., the restoring rate of the rolling strain becomes so great that the yield strength rapidly drops with the sharp increase of the elongation. Over 375° C., both the yield strength and elongation are stabilized within ±10% of the values prior to the rolling. In this sense, in order to perform the reduction without involving any work hardening, the rolling temperature should preferably be 375° C. or above.

It is to be noted that the temperature of a rolling stock generally depends on the generation of heat during the work and the removal of heat with rolls. Where the rolling temperature is 200° C. or above in the reduction of a steel pipe to which the invention is directed, the removal of heat with rolls becomes predominant, so that the temperature of mother pipe drops during the rolling. Accordingly, it is recommended to preliminary assess the temperature drop caused by all stands and to set a heating temperature of a mother pipe at a temperature level which is determined by adding a value corresponding to the temperature drop to a target value of a reduction finishing temperature.

In the practice of the invention, it is preferred to control a difference in temperature along the circumferential direction prior to the reduction of a mother pipe to be within 200° C. It is more preferred that the difference in temperature along the circumferential direction is more severely within 100° C. By virtue of this, the dimensional accuracy of a product pipe can be maintained at a high level as is discussed below.

Figure 7:
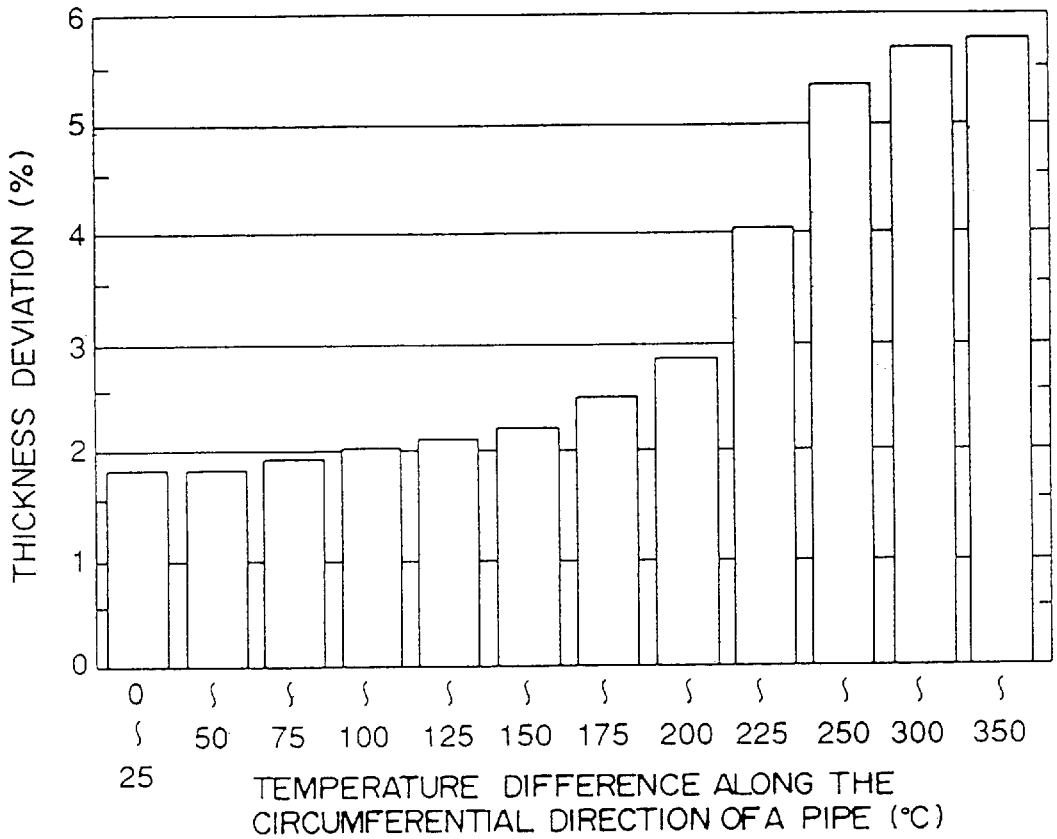
FIG. 7 is a graph showing the relation between the temperature difference of a mother pipe along the circumferential direction of the pipe and the thickness deviation.

FIG. 7 is a graph showing the relation between the temperature difference along the circumferential direction of the mother pipe checked with respect to the steel pipe from which the data of FIGS. 5(*a*) to 6(*b*) were obtained and the thickness deviation of a product steel (i.e. a value (%) obtained by dividing the difference between the maximum and minimum thicknesses by an average thickness). When the temperature difference along the circumferential direction of the mother pipe exceeds 200° C., the deformation along the circumferential direction becomes non-uniform during the reduction, with the likelihood to cause a deviated thickness of a product pipe. Within a temperature range of exceeding 100° C. but not higher than 200° C., the degree of the deviation becomes small while decreasing the temperature difference along the circumferential direction. At temperatures below 100° C., the thickness deviation ascribed to the temperature difference is substantially completely suppressed. It will be noted that where no temperature difference exists, a thickness deviation which is caused by "angled corners" (e.g. a phenomenon where when n caliber rolls are used for the reduction, a 2×nth polygon is formed) inherent to the reduction using a plurality of caliber rolls is left. The seamed portion of the mother pipe is heated to a temperature higher than the other portions. For instance, where the temperature difference along the circumferential direction is not reduced only by application of heat with the induction heating coil 10 of FIG. 1, it is preferred to soak the mother pipe prior to the reduction by combination of heating-cooling (cooling may be effected only on the seamed portion) thereby making a uniform temperature along the circumferential direction.

In the method of the invention, it is favorable to measure the steel pipe temperature at the inlet and outlet sides of the reducer and at the interstand positions and to control the steel pipe temperature being reduced based on the measured values.

Figure 8:
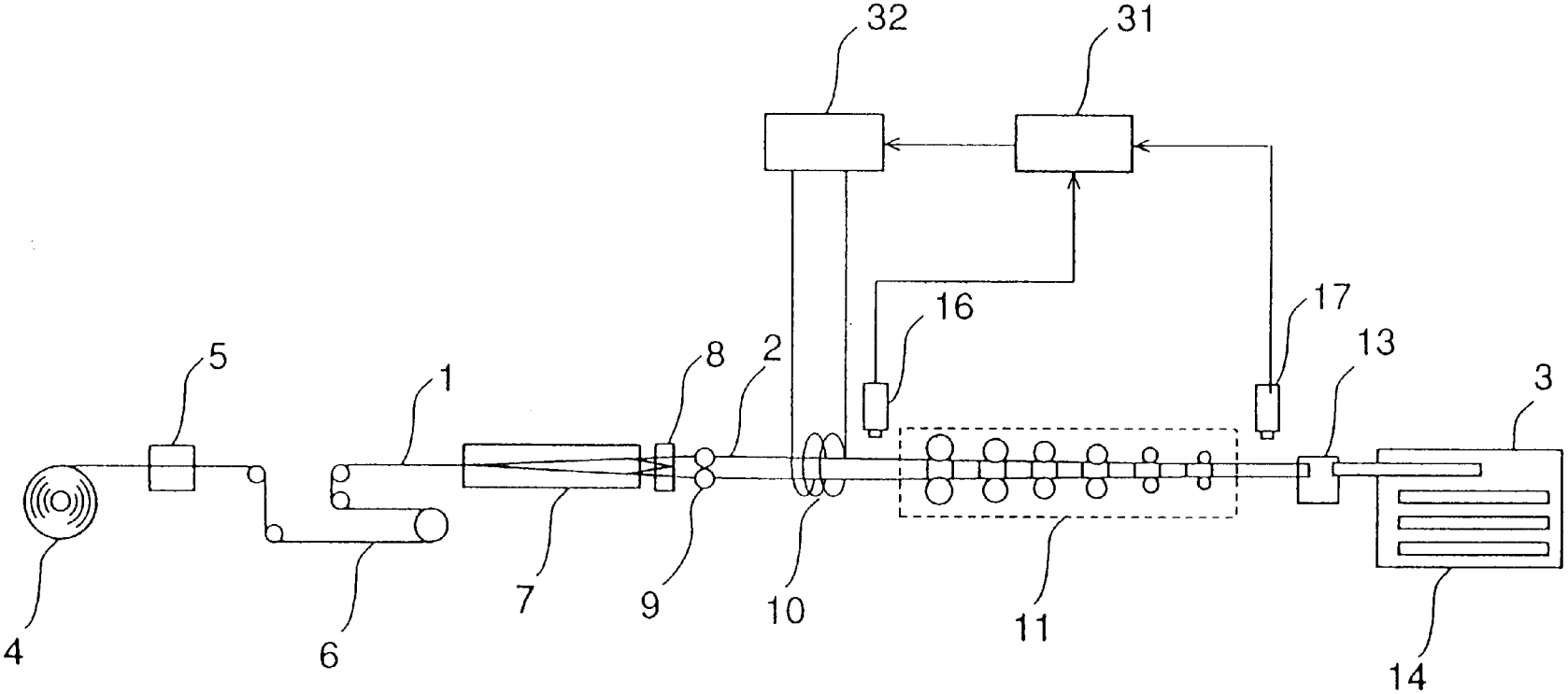
FIG. 8 is a schematic view of a control system used in a conventional reducing temperature control.

FIG. 8 is a schematic view of a control system ordinarily used to control a reduction temperature. In the figure, 31 denotes an arithmetic unit and 32 denotes a heat input control unit. Like reference numerals as in FIG. 2 indicate like members and their explanation is omitted. The control system is so arranged that the arithmetic control unit 31 is inputted with the measured values at the inlet and outlet side thermometers 16, 17 (a temperature measured at the outlet side and a temperature measured at the inlet side). The predicted value of a temperature drop in the reducer 11 is added to the measured temperature at the outlet side to obtain a target temperature at the inlet side. Subsequently, information is transmitted to the heat input control unit 32 for the induction heating coil 10 so that the measured temperature at the inlet side is in coincidence with the target temperature at the inlet side. With the conventional control system, where an error is caused in the prediction of the steel pipe temperature within the reducer 11 by the influence of some disturbances such as variations of caliber rolls and an ambient temperature and a variation in cooling water in the caliber rolls, there is the possibility that the inlet and outlet side temperatures are outside the proper control range depending on the intended quality of a product pipe.

In contrast, since the steep temperature is measured not only at the inlet and outlet sides, but also at the interstand position or positions of the reducer 11, such measured values are also transmitted to the arithmetic device 31 as a control parameter. If a disturbance appears in the reducer 11, the temperature can be instantaneously corrected, not permitting the inlet-outlet side temperatures to be outside the proper control range.

The apparatus of the invention is one which enables one to smoothly carry out the method of the invention. The apparatus comprises a solid phase butt-welding device or a welding device, an inlet side heating furnace, and a reducer composed of a plurality of stands sequentially located in this order, thermometers for measuring a steel pipe at inlet and outlet sides of the reducer, and an arithmetic control device for controlling the inlet side heating furnace based on the measured values from the thermometers, wherein an inlet side soaking device capable of both heating and cooling is provided in place of the inlet side heating furnace, thermometers and an interstand soaking device capable of both heating and cooling are, respectively, provided between the stands of the reducer, and the arithmetic control device controls the inlet side soaking device and the interstand soaking device based on the measured values from the thermometers between the stands.

If the inlet side heating furnace is replaced by an inlet side soaking device, the soaking of the mother pipe prior to the reduction can be performed without any trouble. Since the interstand soaking device is additionally provided, it is more efficiently performed to control the rolling temperature when the reduction is effected by use of the reducer provided downstream of the solid phase butt-welding device or the welding device.

The heating means and the cooling means of the interstand soaking device may be provided at different interstand positions provided that such positions are within the reducer.

In the practice of the invention, it is preferred to use a heating furnace or an induction coil as heating means in the inlet side and interstand soaking devices and a coolant jetting nozzle as cooling means. The heating furnace is favorably an infrared reflection-type furnace which has a good heating efficiency. The coolant may be water or low temperature air. If limitation is placed on the installation space of the reducer, it is more preferred to adopt an induction coil as the heating means in the interstand soaking device. If the heating efficiency-economy is comparable to that of the induction coil, various types of energy beams such as of plasma, electron and laser may be adopted.

Figure 9:
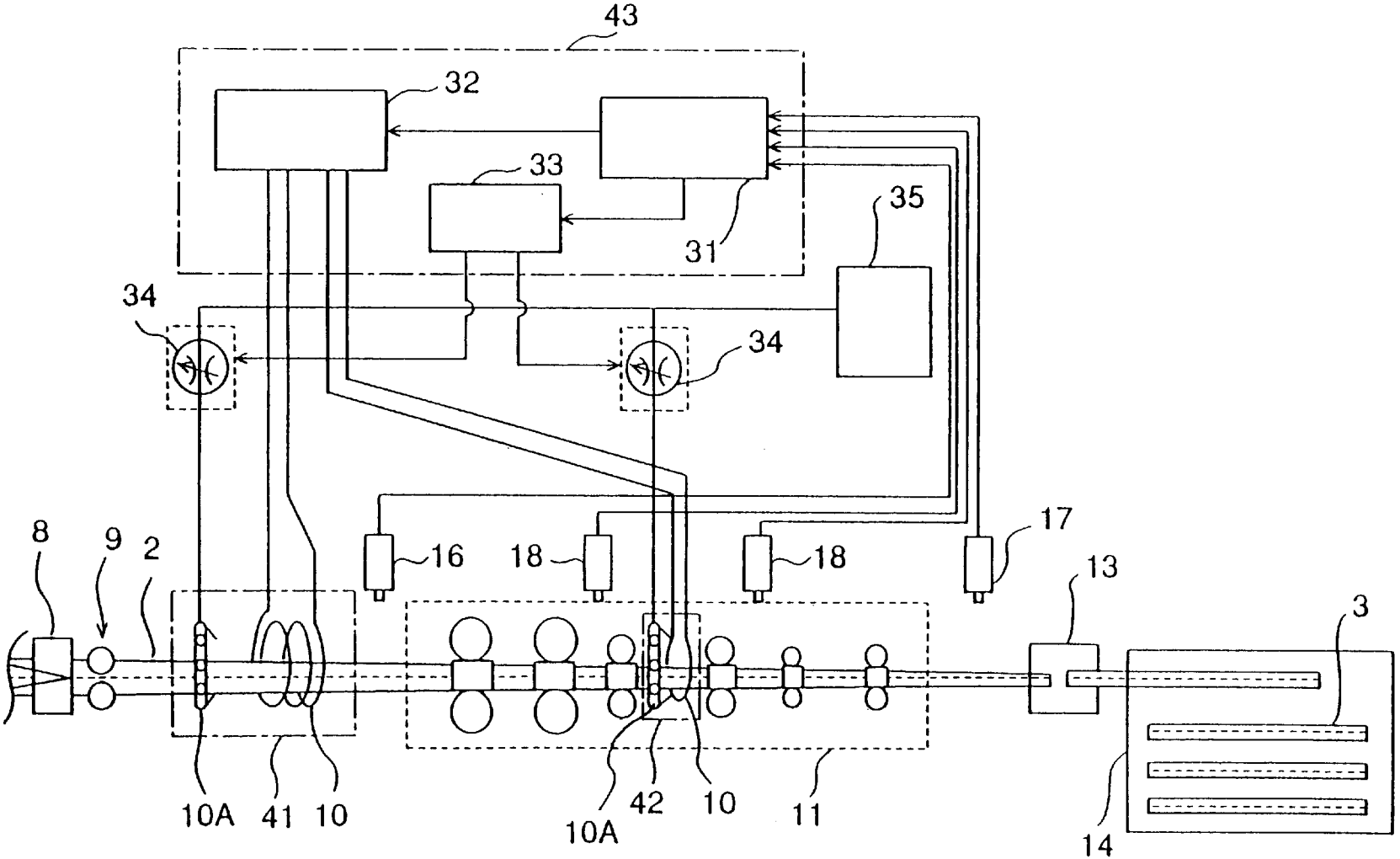
FIG. 9 is a schematic view showing an example of a reducer for steel pipes used in an Example of the invention.
Figure 10:
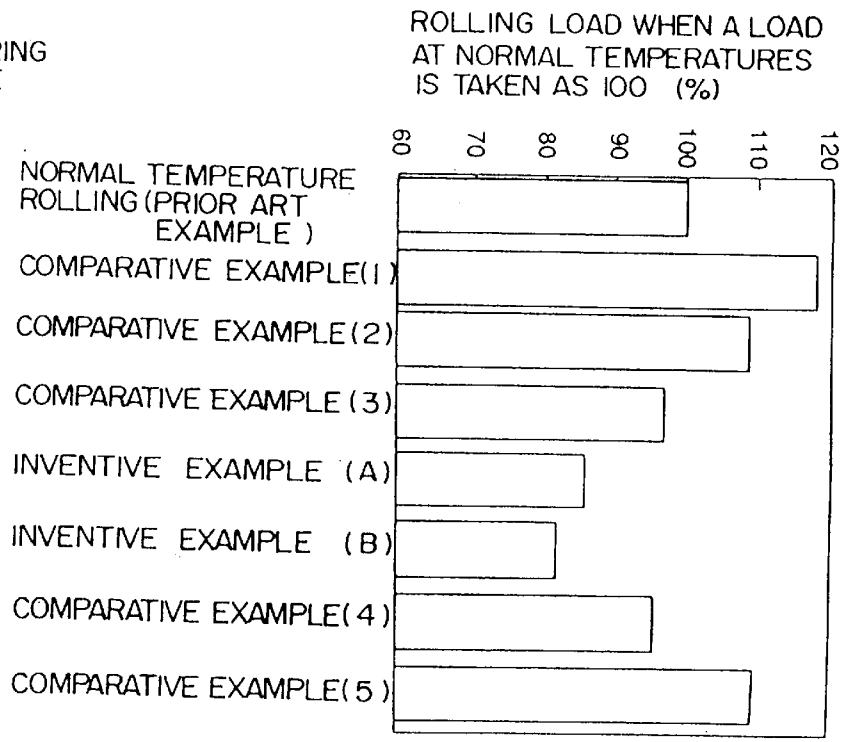
FIG. 10 is a graph showing the total value of rolling loads at each of the stands in the Example.
Figure 11:
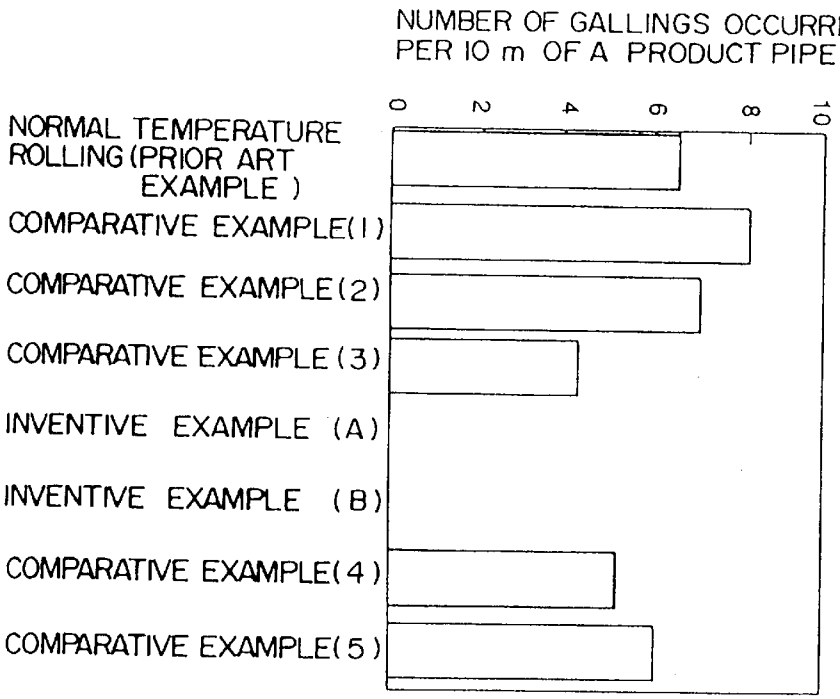
FIG. 11 is a graph showing the number of galling defects on the surfaces of each of the product steel pipes in the Example.
Figure 12:
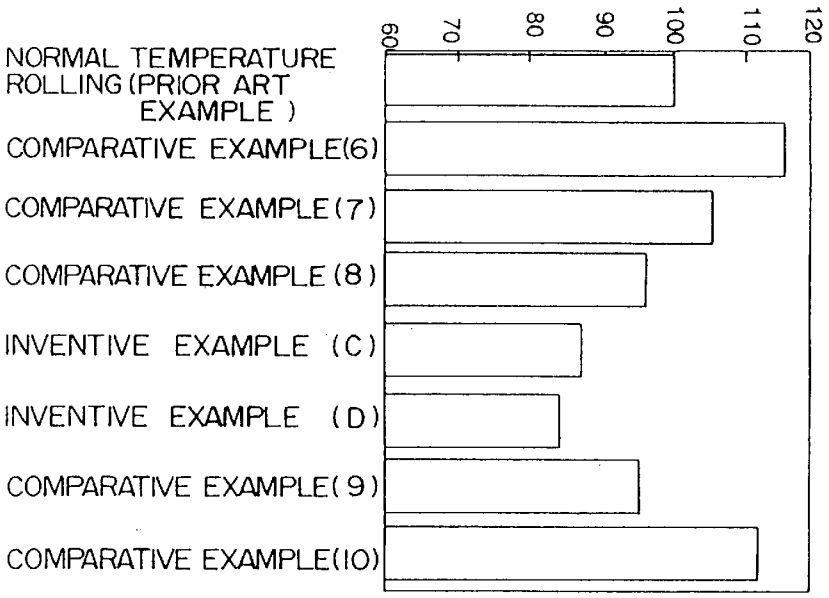
FIG. 12 is a graph showing the total value of rolling loads at each of the stands in another Example.
Figure 13:
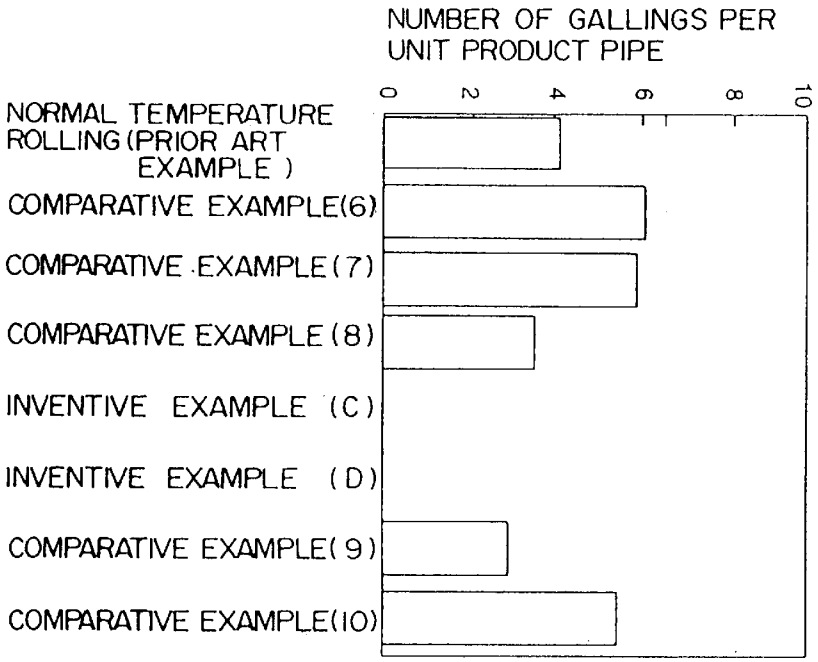
FIG. 13 is a graph showing the number of galling defects on the surfaces of each of the product steel pipes in another Example.

FIG. 9 is a schematic view showing an example of a reducer arrangement of a steel pipe according to the invention. In FIG. 9, indicated by 10A is a coolant jetting nozzle, by 18 are interstand thermometers, by 33 is a flow rate control unit, by 34 is a flow control valve, by 35 is a coolant source, by 41 is an inlet side soaking device, by 42 is an interstand soaking device, by 43 is an arithmetic control device consisting of an arithmetic unit 31, a heat input control unit 32 and a flow control unit 33. It will be noted that in FIG. 9, like reference numerals as in FIG. 8 indicate like members and their explanations are omitted and that at the upstream side of the induction heating device 8 (at the left side of FIG. 8), the same installation arrangement as in FIG. 8 is furnished. In this instance, water is used as a coolant. The inlet side and interstand soaking devices 41, 42 are, respectively, constituted of a coolant jetting nozzle 10A for jetting a coolant from the coolant source 35 through the flow control valve 34 controlled with the flow control unit 33, and the induction heating coil 10 whose power is controlled by means of the input heat control unit 32. Aside from the inlet and outlet side thermometers 16, 17, the thermometers 18 are located upstreamly and downstreamly of the interstand soaking device 42 in the reducer 11. The measurements from these thermometers 16, 17 and 18 are inputted to the arithmetic unit 31, from which information is outputted to the input heat control unit 32 and the flow rate control unit 33 in order to, respectively, keep the measurements of the temperature at the inlet side, the interstand positions and the outlet side within target ranges, thereby controlling the quantity of the input heat and the flow rate of the coolant.

In view of the standpoint of reducing the temperature difference along the circumferential direction of the mother pipe 2, it is preferred that the coolant jetting nozzle 10A of the inlet side soaking device 41 should be so designed as to jet against only the seamed portion, especially with the case of a welded steel pipe wherein the temperature of the seamed portion is high.

(EXAMPLES)

(Example 1)

Using the installation arrangement shown in FIG. 1 (provided with a reducer 11 constituted of 8 stands each having three caliber rolls), a carbon steel pipe for piping corresponding to that described in JIS G 3452 was made in the following manner. A steel strip 1 was formed into a mother pipe 2 having an outer diameter of 27.2 mm and a thickness of 2.3 mm according to a solid phase welding process. The mother pipe 2 was subjected to tandem rolling under the following two conditions (a) and (b) to obtain coiled product pipes 3 having an outer diameter of 17.3 mm and a length of 1000 m.

(a) [Changed in the heating temperature] Using the induction heating coil 10, the heating temperature was changed in the range of 200 to 900° C. to heat the pipe, followed by immediate rolling at a constant speed (150 m/minute) at the outlet side.

(b) [Changed in the outlet side temperature] The pipe was heated at a constant heating temperature (700° C.) by means of the induction heating coil 10, followed by immediate rolling while changing the rolling speed in such a way that the outlet side temperature of the reducer 11 was changed in the range of 150–500° C.

Figure 14:
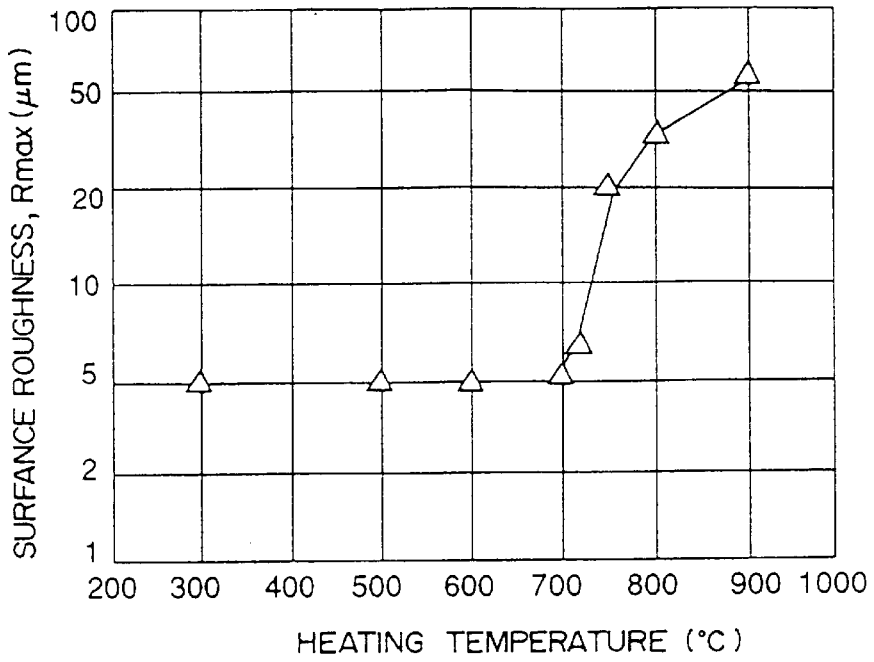
FIG. 14 is a graph showing the relation between the heating temperature and the surface roughness, Rmax, in the Example.
Figure 15:
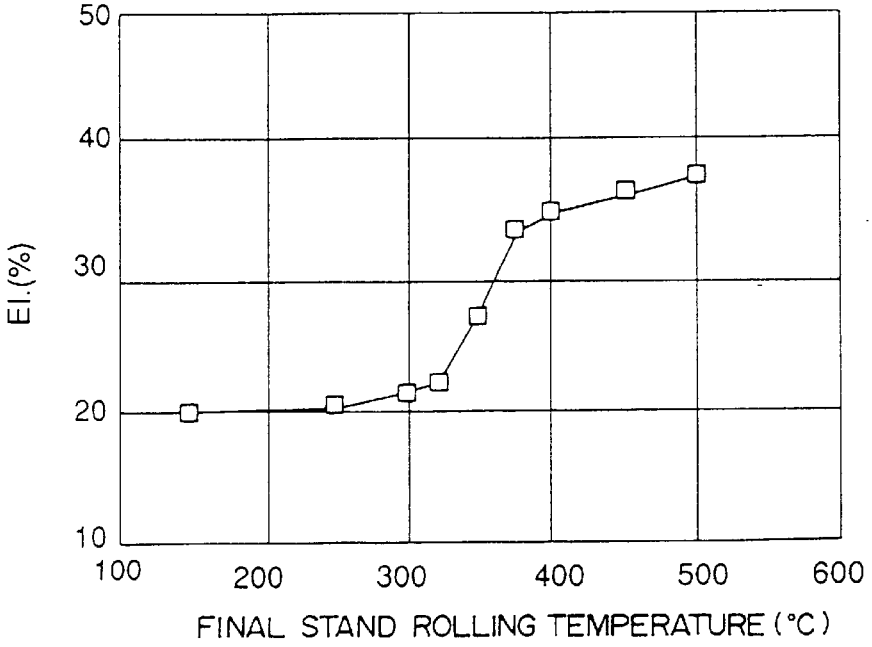
FIG. 15 is a graph showing the relation between the rolling temperature at a final stand and the elongation in the Example.

FIG. 14 is a graph showing the relation between the heating temperature and the surface roughness, Rmax, of the steel pipe obtained under conditions (a). FIG. 15 is a graph showing the relation between the final stand rolling temperature and the elongation (El.) of the steel pipe obtained under conditions (b). The surface roughness, Rmax, of the reduced product pipe 3 is as good as less than 10 $\mu$m when the heating temperature for the mother pipe 2 is not higher than 725° C. which is within the scope of the invention. At temperatures higher than 725° C., it degrades to a level of several tens $\mu$m. The elongation of the reduced product pipe 3 is good at 33% or above when the rolling temperature is 375° C. or above which is within the scope of the invention. When the temperature is lower than 375° C. the elongation does not arrive at 30% and is thus poor.

(Example 2)

Using the installation arrangement shown in FIG. 2 (provided with a reducer 11 constituted of 6 stands each having four caliber rolls), a carbon steel pipe for piping corresponding to that described in JISG3452 was made in the following manner. A steel strip 1 was formed into a mother pipe 2 having an outer diameter of 101.6 mm and a thickness of 4.2 mm according to a welding process. The mother pipe 2 was subjected to tandem rolling under the following two conditions (c) and (d) to obtain product pipes 3 of a given length having an outer diameter of 76.3 mm and a length of 5.5 m wherein 50 pipes were made relative to each level of the respective conditions.

(a) [Changed in the heating temperature] Using the induction heating coil 10, the heating temperature was changed in the range of 400–1000° C. to heat the pipe, followed by immediate rolling at a constant speed (100 m/minute) at the outlet side.

(b) [Changed in the outlet side temperature] The pipe was heated at a constant heating temperature (650° C.) by means of the induction heating coil 10, followed by immediate rolling while changing the rolling speed in such a way that the outlet side temperature of the reducer 11 was changed in the range of 200–500° C.

Figure 16:
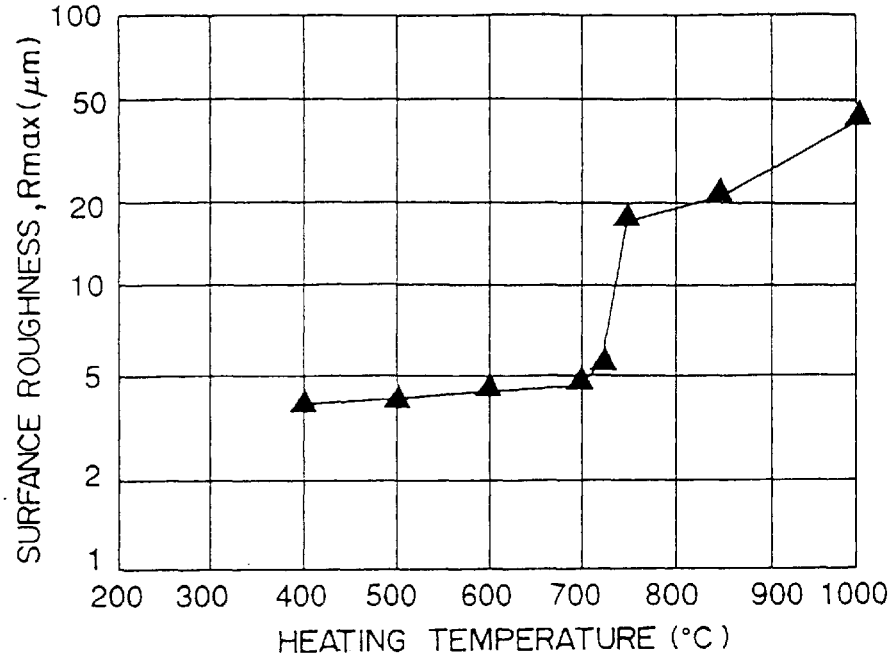
FIG. 16 is a graph showing the relation between the heating temperature and the surface roughness, Rmax, in another Example.
Figure 17:
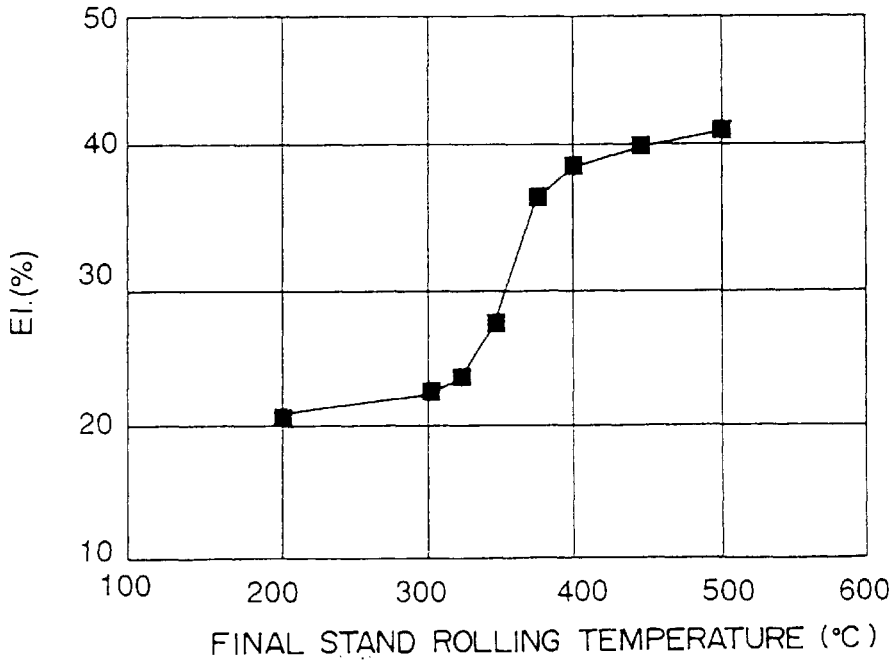
FIG. 17 is a graph showing the relation between the rolling temperature at a final stand and the elongation in another Example.

FIG. 16 is a graph showing the relation between the heating temperature and the surface roughness, Rmax, of the steel pipe obtained under conditions (c). FIG. 17 is a graph showing the relation between the final stand rolling temperature and the elongation (El.) of the steel pipe obtained under conditions (b). The surface roughness, Rmax, of the reduced product pipe 3 is as good as less than 10 $\mu$m when the heating temperature for the mother pipe 2 is not higher than 725° C. which is within the scope of the invention. At temperatures higher than 725° C. it degrades to a level of several tens $\mu$m. The elongation of the reduced product pipe 3 is good at 36% or above when the rolling temperature is 375° C. or above which is within the scope of the invention. When the temperature is lower than 375° C. the elongation does not arrive at 30% and is thus poor.

As will be apparent from Examples 1 and 2, according to the invention, work hardening can be suppressed only by controlling the number of the stands of the reducer 11, which is irrespective of the solid phase welding process and the welding process. Moreover, the product pipes 3 with different outer diameters can be obtained from one kind of mother pipe 2 without involving any worsening of the surface texture as will be caused by scale inclusion. Thus, small lot and multikind steel pipes can be readily manufactured.

Industrial Utility

According to the invention, the steel mother pipes manufactured according to the solid phase butt-welding process or the welding process can be reduced into product pipes with different outer diameters at low load or while suppressing work hardening without worsening the surface properties. This enables one to readily manufacture small lot and multikind pipes. Moreover, product pipes whose dimensional accuracy is at high level can be effectively obtained.

We claim:

1. A method for preparing a steel pipe comprising the steps of:

forming a steel strip to form an open pipe;

subjecting both edges of the open pipe to butt welding; and reducing the welded steel pipe with a plural-stand reducer having caliber rolls;

wherein the steel pipe prior to the reducing step is heated to a temperature between 100° C. and 800° C. and then reduced.

2. A method for preparing a steel pipe according to claim 1, wherein the butt welding consists of butt welding which comprises heating the entirety of the open pipe and subjecting both edge portions to solid phase pressure welding.

3. A method for preparing a steel pipe according to claim 1, wherein the butt welding consists of moderate temperature solid phase welding which comprises heating both edge portions alone of the open pipe and subjecting to solid phase pressure welding.

4. A method for preparing a steel pipe according to claim 1, wherein the butt welding consists of electric resistance welding or laser welding of both edge portions of the open pipe.

5. A method for preparing a steel pipe according to claim 1, further comprising measuring the temperatures of said steel pipe at inlet and outlet sides of said reducer and at interstand positions and heating or cooling said steel pipe prior to the reducing step and during the reducing step so that the resultant measurements are in coincidence with a preset temperature, respectively.

6. A method for preparing a steel pipe according to claim 1, wherein the steel pipe prior to the reducing step is heated to a temperature no greater than 725° C. and reduced in a temperature range no less than 275° C.

7. A method for preparing a steel pipe according to claim 6, wherein the steel pipe prior to the reducing step is heated such that a temperature difference along the circumferential direction of the pipe is within 200° C.

8. A method for preparing a steel pipe according to claim 6, wherein the steel pipe prior to the reducing step is heated such that a temperature difference along the circumferential direction of the pipe is within 100° C.

9. A method for preparing a steel pipe according to claim 6, wherein the temperature of the steel pipe is measured at inlet and outlet sides of the reducer and at interstand positions and the steel pipe prior to and during the reducing step is heated or cooled so that the resultant measurements are coincident with a preset temperature.

10. An apparatus for preparing a steel pipe, comprising:

a welding device;

an inlet side heater;

a reducer having a plurality of stands, the inlet side heater located between the welding device and the reducer;

thermometers for measuring a steel pipe temperature located at inlet and outlet sides of the reducer; and an arithmetic control unit for controlling the inlet side heater based on the measured values from the thermometers;

wherein the inlet side heater is an inlet side soaking device capable of both heating and cooling, additional thermometers and an interstand soaking device capable of both heating and cooling are, respectively, provided between the stands of the reducer, and the arithmetic control unit controls the inlet side soaking device and the interstand soaking device based on the measured values from the additional thermometers between the stands.

11. An apparatus according to claim 10, wherein said inlet side soaking device and said interstand soaking device, respectively, have heating means including a heating furnace or an induction coil and cooling means including a coolant jetting nozzle.

12. A seam butt-welded steel pipe, having a surface roughness, Rmax, that is 10 $\mu$m or less as reduced.

13. An apparatus according to claim 10, wherein the welding device is a solid-phase butt welding device.

14. A method of utilizing the apparatus of claim 10 to make a steel pipe.

15. A steel pipe made by the method of claim 1.

* * * * *